US010117477B2

(12) United States Patent
Chaigne

(10) Patent No.: US 10,117,477 B2
(45) Date of Patent: Nov. 6, 2018

(54) SPORTS BOOT

(71) Applicant: SALOMON S.A.S., Metz-Tessy (FR)

(72) Inventor: Jerome Chaigne, Gruffy (FR)

(73) Assignee: SALOMON S.A.S., Metz-Tessy (FR)

( * ) Notice: Subject to any disclaimer, the term of this patent is extended or adjusted under 35 U.S.C. 154(b) by 0 days.

(21) Appl. No.: 14/710,168

(22) Filed: May 12, 2015

(65) Prior Publication Data

US 2015/0327622 A1 Nov. 19, 2015

(30) Foreign Application Priority Data

May 14, 2014 (FR) ..... 14 01087

(51) Int. Cl.

| | |
|---|---|
| ***A43B 5/00*** | (2006.01) |
| ***A43B 5/04*** | (2006.01) |
| ***A43C 11/00*** | (2006.01) |
| ***A43C 11/14*** | (2006.01) |
| ***A43C 11/16*** | (2006.01) |

(52) U.S. Cl.

CPC ..... *A43B 5/0427* (2013.01); *A43B 5/002* (2013.01); *A43B 5/0447* (2013.01); *A43C 11/008* (2013.01); *A43C 11/142* (2013.01); *A43C 11/146* (2013.01); *A43C 11/16* (2013.01)

(58) Field of Classification Search

CPC ..... A43B 5/0427; A43B 5/002; A43B 5/04; A43B 5/0401; A43B 5/0429; A43B 5/0433; A43B 5/0435; A43B 5/0447; A43B 5/16; A43B 5/1666; A43C 11/146; A43C 11/14; A43C 11/142; A43C 11/1426

USPC ..... 36/114, 115, 117.1, 117.7, 118.1, 50.5, 36/50.1; 24/70 SK, 69 SK, 71 SK, 68 SK

See application file for complete search history.

(56) References Cited

U.S. PATENT DOCUMENTS

| | | | | |
|---|---|---|---|---|
| 3,545,106 A | | 12/1970 | Martin | |
| 4,142,307 A | | 3/1979 | Martin | |
| 4,387,517 A | * | 6/1983 | Annovi | A43B 5/0427 24/71 SK |
| 4,761,898 A | * | 8/1988 | Courvoisier | A43C 11/1413 24/68 SK |
| 4,823,484 A | * | 4/1989 | Couty | A43C 11/008 24/68 SK |

(Continued)

FOREIGN PATENT DOCUMENTS

| | | | | |
|---|---|---|---|---|
| DE | 28 00 187 A1 | | 7/1978 | |
| DE | 9208063 U1 | * | 8/1992 | A43B 5/16 |

(Continued)

*Primary Examiner* — Jameson Collier
*Assistant Examiner* — Heather Mangine
(74) *Attorney, Agent, or Firm* — Greenblum & Bernstein, P.L.C.

(57) ABSTRACT

A sports boot having a rigid shell base designed to hold the foot of a user, the shell base including a sole and two lateral sides extending from the sole and defining an upper recess therebetween. The boot includes a mechanism for tightening the shell base around the foot of the user, the tightening mechanism including a filiform element for tightening the sides towards one another, the filiform element being tightened by pivoting a lever of the mechanism. The lever is provided to be pivoted in a notch of a rack designed to cover the two sides of the shell base in the tightened configuration and to bend the sides towards the sole under the pivoting action of the lever. The rack extends across the upper recess E2.

17 Claims, 3 Drawing Sheets

(56) References Cited

U.S. PATENT DOCUMENTS

| | | | | |
|---|---|---|---|---|
| 4,905,384 | A | 3/1990 | De Marchi et al. | |
| 5,537,763 | A | 7/1996 | Donnadieu et al. | |
| 2013/0298427 | A1* | 11/2013 | Kaushik ..... | A43B 5/04<br>36/117.1 |

FOREIGN PATENT DOCUMENTS

| | | | |
|---|---|---|---|
| DE | 102 39 927 | A1 | 9/2003 |
| EP | 1 396 201 | A1 | 3/2004 |
| FR | 2 607 677 | A1 | 6/1988 |
| FR | 2 620 311 | A1 | 3/1989 |
| FR | 2 697 729 | A1 | 5/1994 |

* cited by examiner

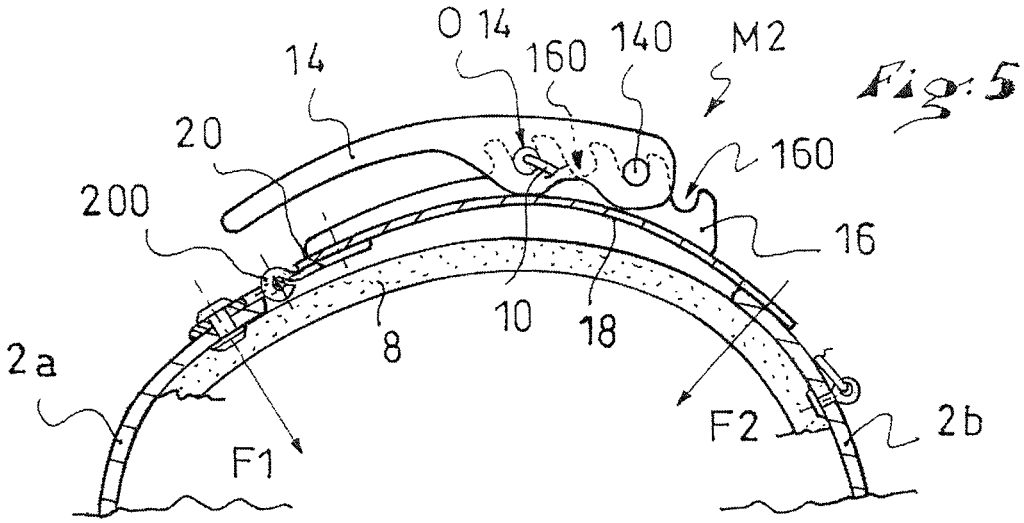
Fig: 5
Fig: 4
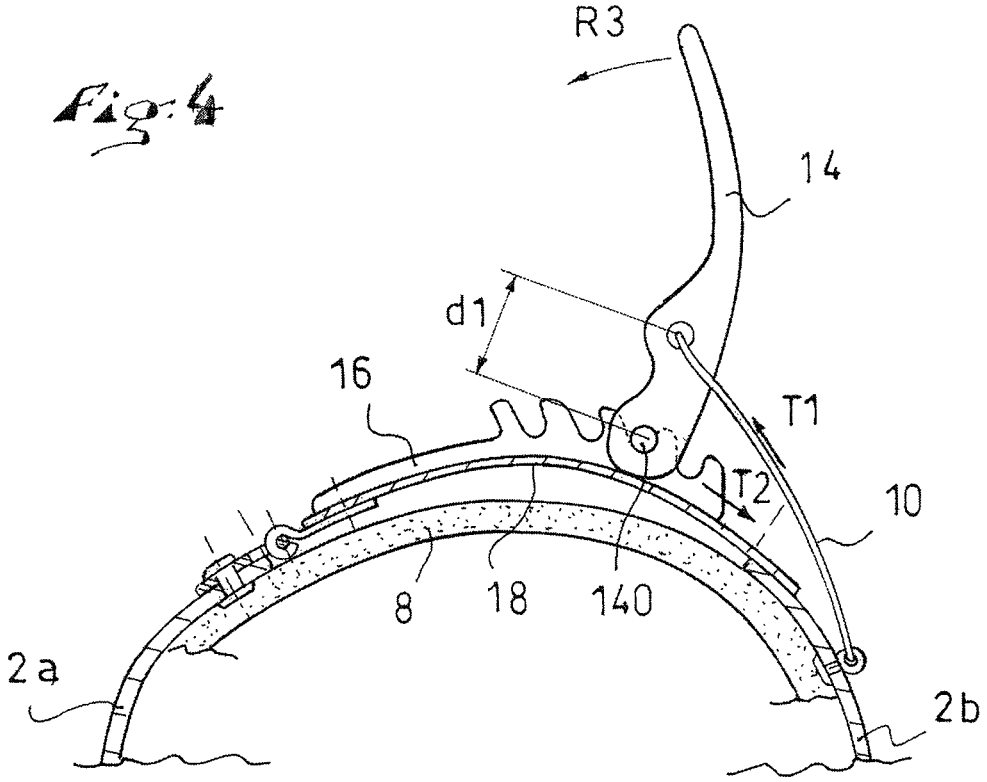

SPORTS BOOT

CROSS-REFERENCE TO RELATED APPLICATION

This application is based upon French Patent Application No. FR 14/01087, filed May 14, 2014, the disclosure of which is hereby incorporated by reference thereto in its entirety, and the priority of which is claimed under 35 U.S.C. § 119.

BACKGROUND

1. Field of Invention

The invention relates to a sports boot, such as a ski, hiking, or mountaineering boot.

2. Description of Background

A sports boot typically includes a lower portion, referred to as the shell base, and an upper portion, referred to as the collar. The shell base includes a sole, from which two sides extend. The shell base and collar support the foot and calf, respectively, of the user. The collar is hinged in relation to the shell base to facilitate walking, but it may be immobilized with respect thereto during the sporting activity in order to block movements of the user's ankle.

The shell base may be rigid or flexible. A flexible shell base can be tightened around the foot of the user using a lace. Lace devices are simple to set up and they are lightweight. However, when they include closed keepers, such devices hinder the insertion of the user's foot because, even when not tightened, they partially obstruct the opening of the boot. Moreover, it is difficult to tighten a rigid shell base simply with a lace. This is why boots having a rigid shell base are equipped with complementary tightening mechanisms, such as hooks, loops, or notched strap tightening devices that increase the tightening force. In this case, several devices are used to replace a single lace.

While hiking, climbing, or skiing, the user may have to perform sidesteps, pass through branches or climb by taking support on an inner or outer side of his boot. However, the mechanisms for tightening the shell base of known boots are arranged on a side of the shell base. Thus, the tightening mechanisms are susceptible to degradation or deactivation by external elements such as stones or branches during the sporting activity.

SUMMARY

The foregoing are drawbacks that the invention remedies by providing a sports boot in which the mechanisms for tightening the shell base are less exposed to external elements such as stones and branches. The risk of the tightening mechanisms being degraded or deactivated during the sporting activity is lower. The invention further provides a device combining the advantages of tightening using a single lace and the advantages of a stronger tightening using a plurality hooks.

The invention also provides a boot whose tightening mechanisms are simple to use, lighter than known devices, and which, when not tightened, do not hinder the insertion of the foot.

To this end the invention relates to a sports boot comprising a rigid shell base for holding the foot of a user, the shell base comprising a sole and two lateral sides extending from the sole, and tightening mechanisms for tightening the shell base around the foot of the user, such tightening mechanisms comprising a filiform element for tightening the sides toward one another which is tightened by pivoting a lever. According to the invention, the lever is designed to be pivoted in a notch of a rack designed to cover the two sides of the shell base in the tightened configuration and to bend the sides towards the sole under the pivoting action of the lever.

The rack is arranged on top of the shell base in the tightened configuration. The rack and the tightening lever are therefore less exposed to stones and branches during the sporting activity. Moreover, the lace provides the boot with a mountain style appreciated by specialists. The shell base is tightened simply by tilting the tightening lever as this involves tightening the lace, on the one hand, and bending the two sides of the shell base around the foot of the user, on the other hand.

According to advantageous but non-essential aspects of the invention, a sports boot thereof may incorporate any of the following features, taken in any technically feasible combination:

The filiform element is a lace, whereas the lever is strung on the lace.

The lever comprises two arms each demarcating a through opening for passage of the lace.

The rack includes a rigid tongue and a notched element fixed to the tongue and including a plurality of notches for receiving the lever.

The rigid tongue is articulated on one of the sides of the shell base.

The rack is configured to bend the sides of the shell base uniformly around the foot of the user.

The tightening lever comprises a pivot shaft within a notch of the rack.

The distance between the pivot shaft of the lever and the lace passage openings is substantially equal to the spacing between two notches of the rack.

The two notches of the rack are separated from one another by an empty notch.

The lever is detached from the shell base.

BRIEF DESCRIPTION OF DRAWINGS

Other features and advantages of the invention will become more apparent from the following description of an embodiment of a sports boot provided by way of example and with reference to the annexed drawings, in which:

FIG. 4 is a cross section similar to FIG. 2, showing the tightening mechanisms in an intermediate configuration in which they are ready to be tightened; and FIG. 5 is a cross section similar to FIGS. 2 and 4, in which the tightening mechanisms are in the tightened configuration.

DETAILED DESCRIPTION

Figure 1:
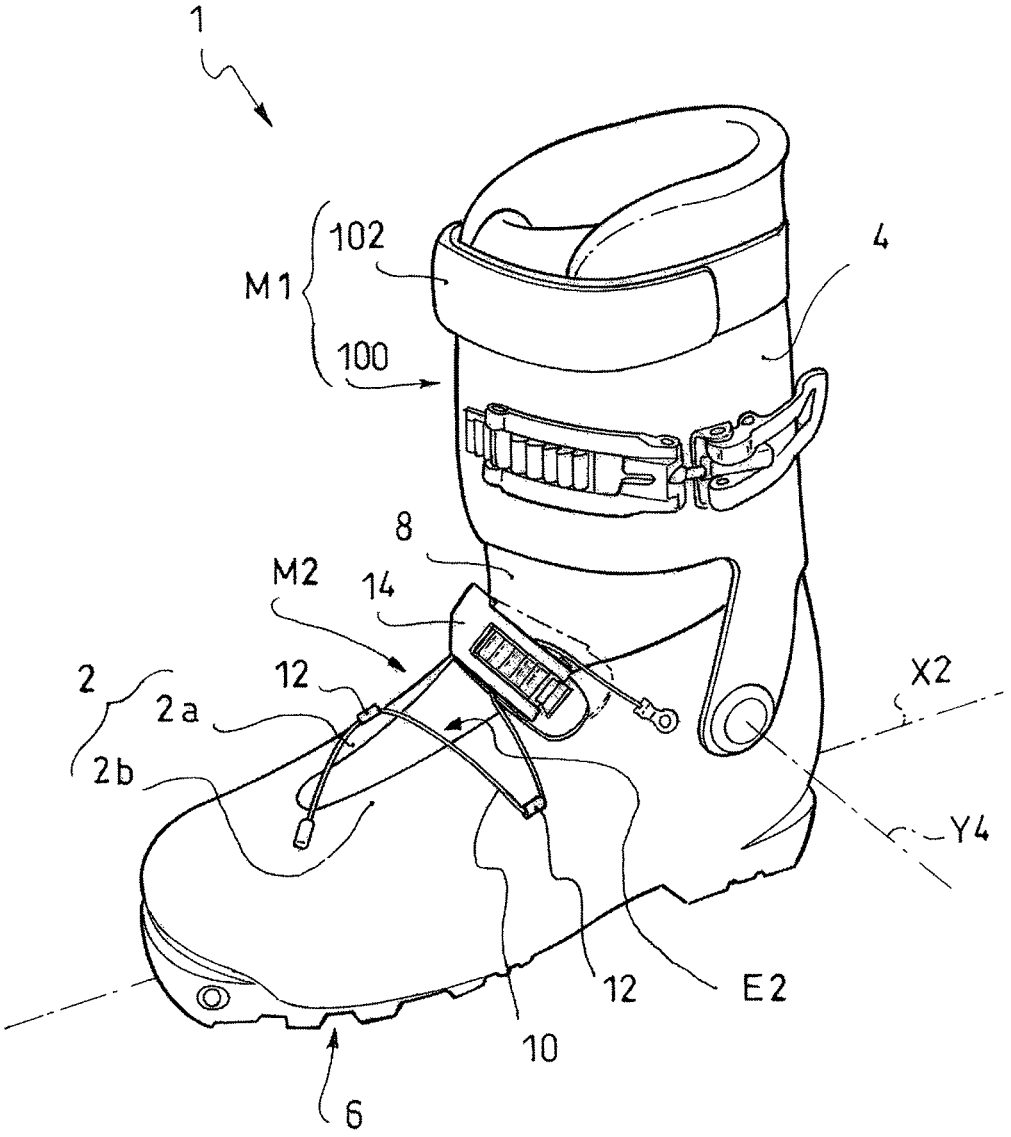
FIG. 1 is a perspective view of a sports boot according to the invention, such boot comprising a shell base and mechanisms for tightening the shell base.

FIG. 1 shows a sports boot 1. The boot 1 is a mountaineering boot for the left foot of a user. The boot 1 can be adapted for hiking or skiing.

The boot 1 comprises a lower portion 2 for receiving and surrounding the foot of the user. The lower portion 2, referred to as the "shell base", holds the foot of the user during walking or skiing. The lower portion 2 is rigid, that is to say, it is made of a material having a modulus of elasticity greater than 500 MPa. In practice, the shell base 2 can be made of plastic. The shell base 2 extends between a front and a rear along a longitudinal axis X2, or along a vertical longitudinal median plane thereof, between the heel and the toes of the user, when the user is wearing the boot 1. The upper portion of the shell base 2 forms a passage opening for the foot of the user. A flexible liner 8, made of foam or fabric, is arranged inside the boot 1 to provide comfort for the user.

The shell base 2 comprises a sole 6, particularly an outsole, and two sides 2*a* and 2*b*, that is, a medial side 2*a* and a lateral side 2*b*, extending generally upwardly from the sole 6. The sides 2*a* and 2*b* extend towards the sole 6, that is, they have a concavity facing the sole 6. The sides 2*a* and 2*b*, together with the sole 6, define a cavity for receiving the foot of the user. The side 2*a* is an inner side, that is to say, it faces the right boot of the user, whereas the side 2*b* is an outer side. The sides 2*a* and 2*b* are transversely spaced apart by an upper opening or recess E2; they do not overlap, as is the case in so-called overlap boots.

The boot 1 also comprises an upper portion 4 for holding the calf of the user, which extends the shell base 2 and is provided to surround the lower leg, that is to say, the calf of the user. This upper portion, referred to as the "collar", is articulated on the shell base 2, in particular about an axis Y4 perpendicular to the longitudinal vertical plane of the longitudinal axis X2 and parallel to the sole 6. The articulation between the collar 8 and the shell base 2 can be blocked during the sporting activity by a locking mechanism, not shown, which is arranged at the rear of the collar 8. Thus, the user's ankle is held during walking or skiing.

The boot 1 comprises mechanisms M1 for tightening the collar 4 around the calf of the user. These mechanisms M1 include a notched tightening device 100 and a self-gripping strip 102, such as a hook-and-loop fastener.

The boot 1 is also equipped with mechanisms M2 for tightening the shell base 2 around the foot of the user. These tightening mechanisms M2 are manipulated by the user between completely loosened configurations shown in FIGS. 2 and 3, an intermediate configuration shown in FIG. 4, and a tightened configuration shown in FIG. 5.

The tightening mechanism M2 includes a filiform element which, in the example, is a lace 10 running along the sides 2*a* and 2*b*. The lace 10 is a fabric cord extending through keepers 12 fixed to the sides 2*a* and 2*b* of the shell base 2. In the example, the keepers 12 are screwed onto the sides 2*a* and 2*b*, but they can also be welded or glued. Tightening the lace 10 makes it possible to bring the sides 2*a* and 2*b* closer to one another and to narrow the upper recess E2.

The tightening mechanisms M2 also include a rack 17 and a tightening lever 14. In the tightened and intermediate configurations, the lever 14 is engaged in the rack 17. A loosened configuration is suitable for inserting the user's foot in the boot 1, because the mechanisms M2 do not prevent the elastic deformation of the shell base 2 for passage of the user's foot.

The rack 17 extends transversely to the axis X2 and comprises a notched metal element 16 for receiving the lever 14, and a rigid tongue 18 which supports the notched element 16. The rigid tongue 18 is bulged or curved, with a concavity facing the sole 6 when the tightening mechanisms M2 are in the intermediate or tightened configuration, that is to say, that its center of curvature is arranged on the side of the sole 6. The notched element 16 can be glued or welded onto the tongue 18. It is provided with notches 160. The rack 17 is articulated on the side 2*a* of the shell base 2 by a hinge 20. The hinge 20 is fixed beneath a proximal end 18*a* of the tongue 18 and comprises a hook 200 yoking a triangular ring screwed to the side 2*a*.

Figure 3:
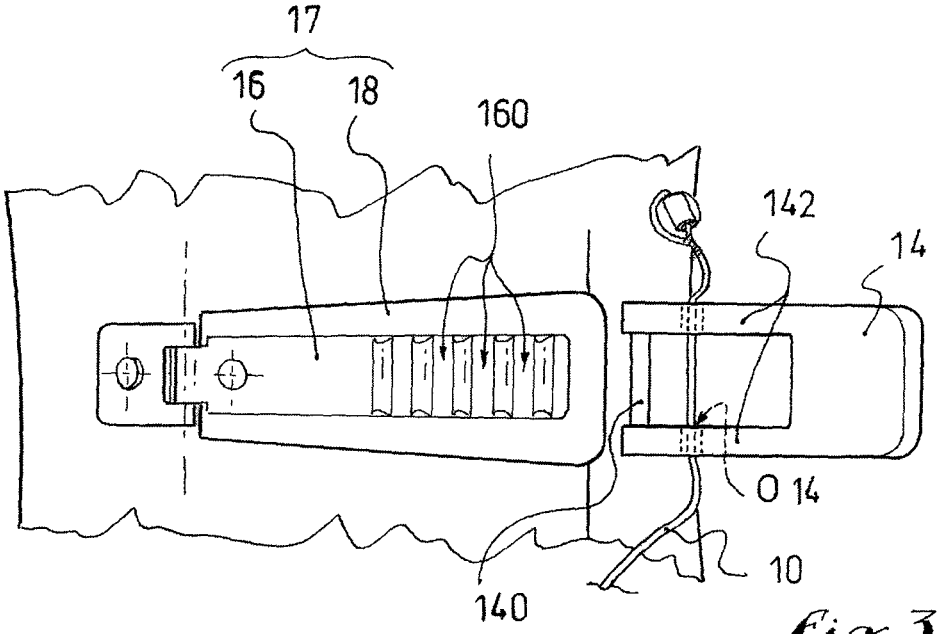
FIG. 3 is a top view of the shell base tightening mechanisms in a loosened configuration similar to that of FIG. 2.

The lever 14 includes a hinge shaft 140, provided to be housed in a notch 160 of the notched element 16. As shown in FIG. 3, the lever 14 comprises two arms 142 demarcating two through openings O14 aligned with one another. The hinge shaft 140 also extends through the arms 142 of the lever 14 and is rotatable about its axis. The openings O14 are for passage of the lace 10. The lever 14 is thus strung on the lace 10. Consequently, the lace 10 is tightened by pivoting the lever 14 in a notch 160 of the rack 17. Furthermore, the lever 14 is detached from the shell base 2 and is free to slide along the lace 10. It could be said that in the loosened configuration of the tightening mechanism, the lever 14 is detached from the shell base 2 but tethered to the shell base via the filiform element 10.

To put on the boot, the user begins by clearing the rack 17 by tilting it around the shaft end straddled by the hook 200. The lace 10 is also loosened and the user can easily insert his foot inside the boot 1.

Figure 2:
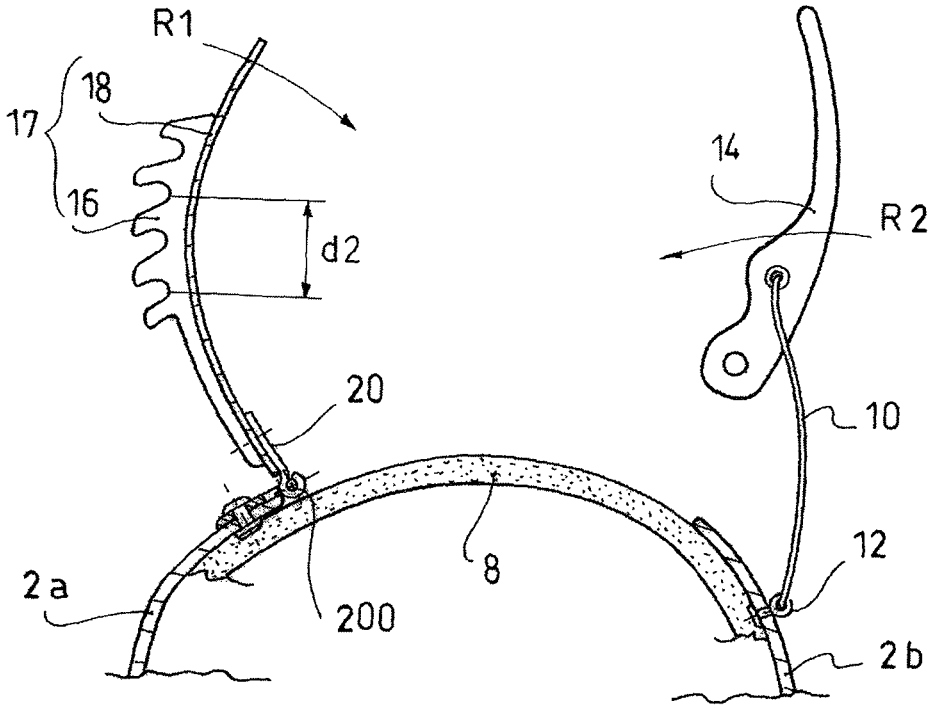
FIG. 2 is a partial cross section showing the mechanisms for tightening the shell base in a completely loosened configuration.

To tighten the foot within the shell base 2, the user folds the rack 17 towards the side 2*b* as shown by the arrow R1 in FIG. 2. The user then pulls the lace 10 and brings the lever 14 towards the notched element 16, as shown by the arrow R2 in FIG. 2. The user engages the hinge shaft 140 of the lever 14 in a notch 160 of the notched element 16, with the lever portion, i.e., the hinge shaft 140 in the illustrated embodiment, above the recess or opening E2. The tightening mechanisms M2 are then in the intermediate configuration of FIG. 4. The user's foot is more firmly tightened inside the shell base 2 as the notch in which the shaft 140 is engaged is close to the side 2*a*.

Then, the user tilts the lever 14 from his left to his right, that is to say, towards the side 2*a*. The tilting of the lever 14 is shown in FIG. 4 by an arrow R3. The tightening mechanisms M2 are then in the tightened configuration of FIG. 5. The tilting of the lever 14 concurrently causes a tension T1 on the lace 10 and a force T2 pulling the rack 17 towards the side 2*b*. The tension T1 applied to the lace 10 makes it possible to tighten the lace 10 and to bring the sides 2*a* and 2*b* closer to one another. The lace 10 thus makes it possible to tighten the wearer's foot widthwise.

In the tightened configuration, the rack 17 covers, or overlaps, the sides 2*a* and 2*b* due to the tensile force T2 of the lever 14. In other words, the rack 17 serves as a bridge between the sides 2*a* and 2*b*. Indeed, the rack 17, or more precisely the rigid tongue 18, takes support on the side 2*a*, via the hinge 20, and on the side 2*b*, via the distal end 18*b* of the tongue 18. Furthermore, the rack straddles across the recess E2 and the lever engages the rack at a position above the recess or opening and, in the configuration shown in FIG. 5, between the medial and lateral sides 2*a*, 2*b* of the shell base. The rack 17 is therefore arranged in the center and on top of the shell base 2. It is advantageously less exposed to the branches and stones when climbing or passing between branches.

The tensile force T2 on the rack 17 makes it possible to bend the sides 2*a* and 2*b* in the direction of the sole 6, which has the effect of compressing the foot of the user heightwise. More specifically, it is the rigid tongue 18 which bends the sides 2*a* and 2*b* of the shell base 2. The tongue 18 pulls on the side 2*a*, on the one hand, and presses on the side 2*b*, on the other hand. The recess E2 provides a certain flexibility to the shell base 2, thereby enabling the shell base 2 to deform elastically under the pivoting action of the lever 14. F1 and F2 designate the bending forces of the rack 17 on the sides 2*a* and 2*b*, respectively. The bending forces F1 and F2 are directed towards the sole 6, that is to say, they make it possible to accentuate the curvature of the sides 2*a* and 2*b*. The bending forces F1 and F2 are equivalent, that is to say, the rack 17 substantially uniformly presses on the sides 2*a* and 2*b* of the shell base 2. Therefore, the user does not have the sensation of having one side tighter than the other.

The tilting of the lever 14 also causes the lace 10 to be housed in a notch 160 of the notched element 16. More specifically, the passage openings O14 for the lace 10 are separated from the hinge shaft 140 by a distance d1 corresponding to the spacing d2 between two notches of the notched element 16. Thus, the lace 10 is automatically blocked in the notched element 16 by tilting the lever 14. The two notches for receiving the shaft 140 and the lace 10 are separated by an empty notch.

In an alternative embodiment not shown, the lever 14 can be immovably strung on the lace 10.

In an alternative embodiment not shown, the lever 14 is attached to the shell base 2.

According to another alternative embodiment not shown, the lace 10 and the lever 14 may be linked by weld spots.

According to an alternative embodiment not shown, the notched element 16 and the rigid tongue 18 are integral or one-piece.

According to another alternative embodiment, the lace 10 is replaced by a metal cable, which is also a filiform element.

The technical features of the embodiments and alternatives considered above can be combined to generate other embodiments of the invention.

Further, at least because the invention is disclosed herein in a manner that enables one to make and use it, by virtue of the disclosure of particular exemplary embodiments of the invention, the invention can be practiced in the absence of any additional element or additional structure that is not specifically disclosed herein.

The invention claimed is:

1. A sports boot comprising:

a rigid shell base designed to hold a foot of a user, the shell base extending between a front and a rear of the boot along a longitudinal vertical median plane and comprising:

a sole;

a medial side and a lateral side extending upwardly from the sole, at least respective outer surface portions of the medial and lateral sides being transversely spaced apart by a recess or opening, each of the medial and lateral sides of the shell base having a concavity facing the sole, the sole and the medial and lateral sides of the shell base defining a foot-receiving cavity; and a shell-base tightening mechanism movable between a loosened configuration and a tightened configuration and designed, in the tightened configuration, to tighten the shell base around the foot of the user at the foot-receiving cavity, the shell-base tightening mechanism comprising:

a filiform element configured to tighten the medial and lateral sides towards one another and toward the sole;

a rack comprising a rigid tongue extending, in the tightened configuration of the tightening mechanism, between the medial and lateral sides, over the foot-receiving cavity, over the recess or opening, and through the longitudinal vertical median plane of the shell base;

the rack further comprising a notched element fixed on the tongue, the notched element comprising a plurality of spaced apart notches; and a lever connected to the filiform element, the lever having a portion configured to be received and engaged in a selective one of the plurality of notches above the recess or opening to pivotally connect the lever in relation to the rack to move the tightening mechanism in a tightening direction toward the tightened configuration and to thereby bend the medial and lateral sides of the shell base in the tightened configuration, with the rack transversely straddling and extending across the recess or opening of the shell base in the tightened configuration;

wherein the rigid tongue has two longitudinal edges;

wherein the notched element has two longitudinal edges; and wherein the two longitudinal edges of the notched element are spaced inward and apart from the two longitudinal edges of the rigid tongue.

2. A sports boot according to claim 1, wherein:

the rack is supported on each of the medial and lateral sides.

3. A sports boot according to claim 1, wherein:

the filiform element is a lace; and the lever is strung on the lace.

4. A sports boot according to claim 1, wherein:

the lever comprises two arms, each of the arms demarcating a through opening for passage of the filiform element.

5. A sports boot according to claim 1, wherein:

the rigid tongue is mounted for articulation on one of the medial and lateral sides of the shell base.

6. A sports boot according to claim 1, wherein:

the rack is configured to bend the medial and lateral sides of the shell base uniformly around the foot of the user.

7. A sports boot according to claim 1, wherein:

the portion of the lever that is configured to be received in the notches is a pivoting shaft designed to pivot within any of the plurality of notches of the rack.

8. A sports boot according to claim 7, wherein:

the lever comprises two arms, each of the arms demarcating a through opening for passage of the filiform element;

a distance between the pivoting shaft of the lever and the through openings for passage of the filiform element is substantially equal to a spacing between two notches of the rack.

9. A sports boot according to claim 8, wherein:

the two notches of the rack are separated from one another by an empty notch.

10. A sports boot according to claim 1, wherein:

the lever is detached from the shell base.

11. A sports boot according to claim 1, wherein:

in the loosened configuration of the tightening mechanism, the lever is detached from the shell base but tethered to the shell base via the filiform element.

12. A sports boot according to claim 1, wherein:

the shell base has a modulus of elasticity greater than 500 MPa.

13. A sports boot according to claim 1, further comprising:

a collar connected to and extending upwardly from the shell base, the collar being designed to extend around a lower leg of the user.

14. A sports boot according to claim 13, further comprising:

a collar tightening mechanism designed to tighten the collar around a calf of the user.

15. A sports boot according to claim 1, wherein:

along a length of the filiform element the filiform element extends at least as follows:

from along a first side of one of the medial and lateral sides of the shell base to along a second side of the medial and lateral sides; and back to the first side of the medial and lateral sides.

16. A sports boot comprising:

a rigid shell base designed to hold a foot of a user, the shell base extending between a front and a rear of the boot along a longitudinal vertical median plane and comprising:

a sole;

a medial side and a lateral side extending upwardly from the sole;

the medial and lateral sides being non-overlapping;

at least respective outer surface portions of the medial and lateral sides being transversely spaced apart by a recess or opening extending longitudinally along a top of the shell base;

each of the medial and lateral sides of the shell base having a concavity facing the sole, the sole and the medial and lateral sides of the shell base defining a foot-receiving cavity; and a shell-base tightening mechanism movable between a loosened configuration and a tightened configuration and designed, in the tightened configuration, to tighten the shell base around the foot of the user at the foot-receiving cavity, the shell-base tightening mechanism comprising:

a filiform element configured to tighten the medial and lateral sides towards one another and toward the sole;

a rack comprising a rigid tongue extending, in the tightened configuration of the tightening mechanism, between the medial and lateral sides, over the foot-receiving cavity, over the recess or opening, and through the longitudinal vertical median plane of the shell base;

the rack further comprising a notched element fixed on the tongue, the notched element comprising a plurality of spaced apart notches; and a lever connected to the filiform element, the lever having a portion engaged in a selective one of the plurality of notches above the recess or opening at least in the tightened configuration to thereby connect the lever to the rack;

in the loosened configuration:

the lever is in a non-force-applying position; and the medial and lateral sides of the shell base are in a foot-insertion position; and in the tightened configuration:

the lever is in foot-holding position;

the medial and lateral sides of the shell base are closer together than in the foot-insertion position; and the rack transversely straddles and extends across the recess or opening of the shell base;

wherein the rigid tongue has two longitudinal edges;

wherein the notched element has two longitudinal edges; and wherein the two longitudinal edges of the notched element are spaced inward and apart from the two longitudinal edges of the rigid tongue.

17. A sports boot according to claim 16, wherein:

in the tightened configuration, the rack is transversely centered on the top of the shell base.

* * * * *